US005919115A

United States Patent [19]

Horowitz et al.

[11] Patent Number: 5,919,115

[45] Date of Patent: Jul. 6, 1999

[54] ADAPTIVE EXERCISE MACHINE

[75] Inventors: Roberto Horowitz, El Cerrito; Joel Shields; Perry Li, both of Berkeley; Steven L. Lehman, Albany, all of Calif.

[73] Assignee: The Regents of theUniversity of California, Oakland, Calif.

[21] Appl. No.: 08/330,758

[22] Filed: Oct. 28, 1994

[51] Int. Cl.[6] ..... A63B 21/00

[52] U.S. Cl. ..... 482/6; 482/1; 482/5; 482/8; 482/7; 482/901

[58] Field of Search ..... 482/1–9, 900–902; 73/379.01–379.09

[56] References Cited

U.S. PATENT DOCUMENTS

| | | | |
|---|---|---|---|
| 2,777,439 | 1/1957 | Tuttle . | |
| 2,921,791 | 1/1960 | Berne . | |
| 3,103,357 | 9/1963 | Berne . | |
| 3,212,776 | 10/1965 | Bassler . | |
| 3,465,592 | 9/1969 | Perrine . | |
| 3,495,824 | 2/1970 | Cuinier . | |
| 3,589,193 | 6/1971 | Thanton . | |
| 3,784,194 | 1/1974 | Perrine . | |
| 3,848,467 | 11/1974 | Flavell . | |
| 3,869,121 | 3/1975 | Flavell . | |
| 4,082,267 | 4/1978 | Flavell . | |
| 4,184,678 | 1/1980 | Flavell et al. | 272/DIG. 6 |
| 4,261,562 | 4/1981 | Flavell . | |
| 4,601,468 | 7/1986 | Bond et al. | 482/901 X |
| 4,628,910 | 12/1986 | Krukowski | 482/901 X |
| 5,201,772 | 4/1993 | Maxwell | 482/901 X |
| 5,244,441 | 9/1993 | Dempster | 482/901 X |

*Primary Examiner*—Richard J. Apley
*Assistant Examiner*—Glenn Richman
*Attorney, Agent, or Firm*—Fish & Richardson, P.C.

[57] ABSTRACT

An apparatus and method for controlling the torque of an exercise machine acting on a user is disclosed. The invention determines the torque which the user is able to exert at different positions and velocities, and develops a strength model of the user. Based on the strength model of the user, the invention determines a desired velocity profile for the user's exercise. The velocity profile may be chosen to maximize the amount of power output by the user or to provide whatever other type of exercise specified. The invention then controls the torque acting on the user so that the exercise is accomplished according to the desired velocity profile.

24 Claims, 5 Drawing Sheets

M(x)
a
C(x)
P(t)
174
175
176
180
181
190
191
192
193
194
195
196
160
161
162
163
164
165
166
170
171
172
173
s1
s2
s3
s4
s5
P
Q
Ø

ADAPTIVE EXERCISE MACHINE

BACKGROUND OF THE INVENTION

The present invention relates generally to the use of strength identification in the design and implementation of control systems for exercise equipment, and more particularly to a method and apparatus for strength identification and control of an exercise machine based upon the velocity dependence of the strength of the user.

Improvements or atrophy in muscular capacity are related to the type of activities performed. For example, an astronaut living in a gravity free environment requires very little strength to perform his daily tasks; thus over time, the astronauts' body will lose its muscular definition. On the other hand, a bodybuilder will increase his strength over time due to the repetitive loading of the various muscle groups. This idea has been formalized with the so called "Principle of Specificity." This principle states that an important factor in establishing a training routine is to try to develop exercises that will train the body in a highly specific manner, thereby improving its response to the precise demands that will be placed upon it in competition or in everyday life. By training the body in a highly specific manner it is thought the proper neural and physiological adaptations take place in the body. For example, endurance training increases the number of mitochondria in the muscle cell making it more able to metabolize fats.

Typically exercise machines are configured to take advantage of the Principle of Specificity in two ways. First, by isolating a particular muscle, or group of muscles, and then by providing the particular resistance desired by the user. Usually, the resistance provided by the exercise machine can be categorized into one of three groups: "isotonic" (constant torque), "isokinetic" (constant velocity), or "isometric" (constant position). Furthermore, in some of the state-of-the-art exercise machines, a variable radius cam is used in conjunction with a weight stack so that a configuration dependent resistance is achieved. This position dependent resistance is important because of the varying geometry of the musculoskeletal leverage system.

Prior art exercise machines may incorporate some type of program that controls torque or velocity which may be selected by the user. It is believed, however, that no prior art machine identifies the strength characteristic of the user and adapts the exercise program to the user based on the strength data gathered. For example, U.S. Pat. No. 2,777,439 discloses a method of providing a resistance which varies with position. U.S. Pat. No. 2,921,791 discloses a device which provides a constant resistive torque. U.S. Pat. Nos. 3,212,776; 3,465,592 and 3,784,194 disclose machines which automatically adjust resistance to maintain a constant speed of exercise motion. Likewise, U.S. Pat. Nos. 4,184,678; 3,848,467; 3,869,121; 4,082,267 and 4,261,562 disclose various methods of producing and electrically controlling a resistive torque to produce a preselected program of a plurality of constant velocity motions. U.S. Pat. No. 3,589,193 discloses several methods of providing predetermined types of resistance torques in an ergometer.

None of the prior art exercise devices discussed above provide a method of testing user strength and adapting the resistance accordingly to provide a specified type of workout. An object of the present invention is to provide a method of testing the strength characteristic of a user of an exercise machine and controlling the resistance of the machine based on the strength data gathered.

Another object of the present invention is to provide a method of optimizing the power output of the user.

Another object of the present invention is to provide a controller which has the desirable property of being passive (i.e. safe to operate) and can regulate the velocity of the workout to conform to a desired position dependent function which may be specified by a performance index.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the claims.

SUMMARY OF INVENTION

The current invention is an apparatus and method for controlling the torque of an exercise machine acting on a user. The invention determines the torque which the user is able to exert at different positions and velocities, and develops a strength model of the user. Based on the strength model of the user, the invention determines a desired velocity profile for the user's exercise. The velocity profile may be chosen to maximize the amount of power output by the user or to provide whatever other type of exercise is desired. The invention then controls the torque acting on the user so that the exercise is accomplished according to the desired velocity profile.

BRIEF DESCRIPTION OF THE DRAWINGS

The accompanying drawings, which are incorporated in and form a part of this specification, illustrate embodiments of the invention and, together with the following detailed description, serve to explain the principles of the invention.

DETAILED DESCRIPTION OF THE INVENTION

The present invention will be described in terms of the preferred embodiment. The preferred embodiment is an apparatus and method for testing a user's strength characteristics and adapting the resistive torque of an exercise machine according to those characteristics. Such a system is shown in FIG. 1.

Figure 1:
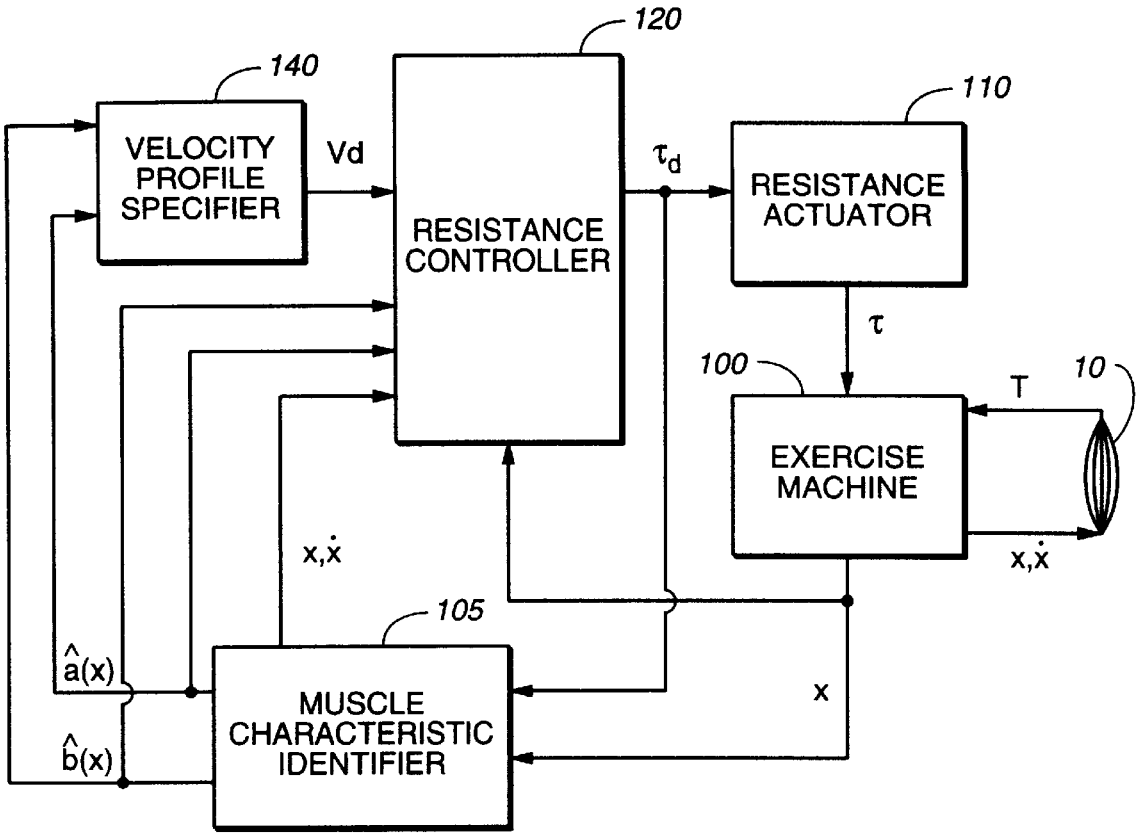
FIG. 1 is a schematic block diagram of the preferred embodiment of the present invention.

As is shown in FIG. 1, and as discussed in more detail below, a user 10 exercises on an exercise machine 100 such as an exercise bike, stair climber, or rowing machine by exerting a torque T. The signal T can be either a force or torque depending upon the configuration of the exercise machine 100. Position data x is transferred from exercise machine 100 to a muscle characteristic identifier 105. Similarly to T, that x can represent either linear position or angular position depending on the configuration of the exercise machine 100. Henceforth, x and T will be considered as angular position and torque, respectively. The resistance actuator 110 is a device which causes the torque $\tau$ that the exercise machine 100 exerts on the user 10 to increase or decrease according to the commands of the resistance controller 120. The muscle characteristic identifier 105 characterizes the strength of the user 10. The muscle characteristic identifier 105 estimates strength parameters $\hat{a}(x)$ and $\hat{b}(X)$ and sends them, along with the position data x, and the velocity data $\dot{x}$ to the resistance controller 120. The muscle characteristic identifier 105 also sends the strength parameters, $\hat{a}(x)$ and $\hat{b}(x)$ to a velocity profile specifier 140. The velocity profile specifier 140 determines a velocity profile Vd and sends Vd to the resistance controller 120. The resistance controller 120 outputs the new desired torque, $\tau_d$ to the resistance actuator 110. The resistance actuator 110 is controlled by the resistance controller 120 to produce a torque $\tau$ on the exercise machine 100 that minimizes the tracking error from the desired velocity profile. This results in user 10 executing the exercise motion at position x and velocity $\dot{x}$. The torque command to the resistance actuator 110 is calculated by resistance controller 120 based upon the velocity profile Vd and the current strength information of the user 10.

Figure 2:
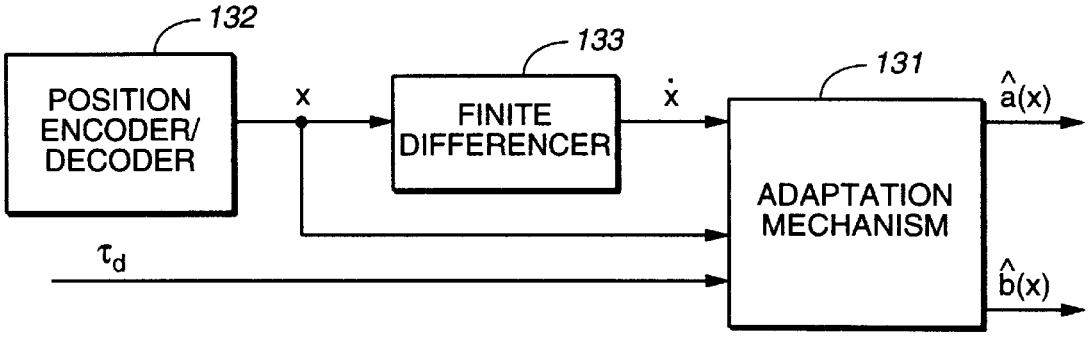
FIG. 2 is a schematic block diagram of the muscle characteristic identifier of the present invention.

FIG. 2 shows an input/output diagram of the muscle characteristic identifier 105. The muscle characteristic identifier 105 estimates the strength of the user 10 using an adaptation mechanism 131. A position encoder/decoder 132 monitors the position of the exercise motion using an optical sensor or other method commonly known in the art and sends a position signal x to a finite differencing module 133 within the muscle characteristic identifier 105. The finite differencing module 133 calculates the velocity of the exercise motion $\dot{x}$ using a backward differencing method. This method simply divides the difference between the current position measurement and the previous position measurement by the sampling time of the control software. The $\dot{x}$ data is sent to the adaptation mechanism, along with the position data x. The adaptation mechanism 131 also receives as input $\tau_d$ which comes from resistance controller 120. The adaptation mechanism 131 outputs the current estimates of the strength parameters $\hat{a}(x)$ and $\hat{b}(x)$.

Figure 3:
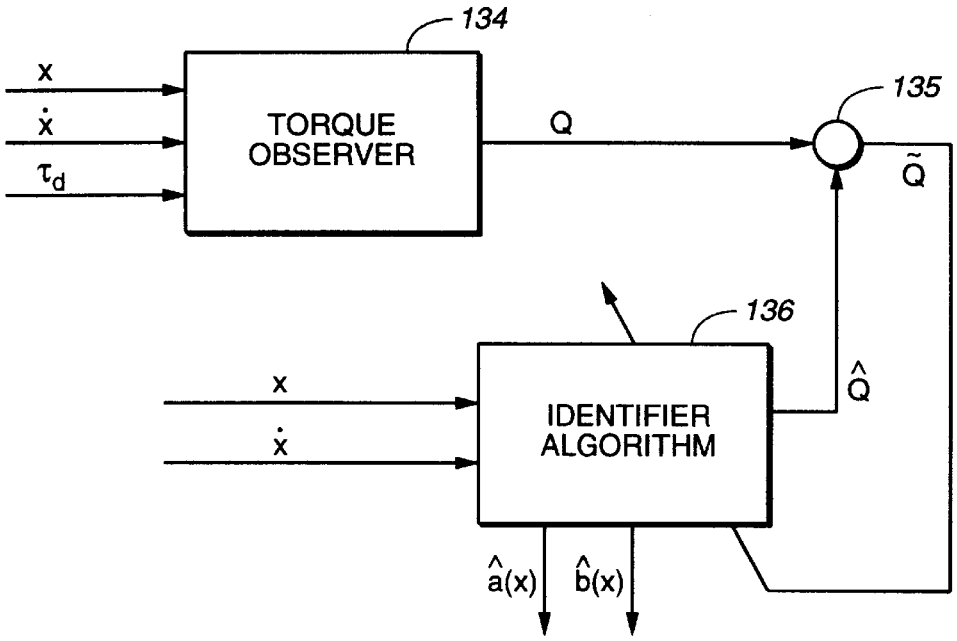
FIG. 3 is a schematic block diagram of the adaptation mechanism of the present invention.

FIG. 3 shows a schematic block diagram of the adaptation mechanism 131. The adaptation mechanism 131 calculates the strength parameters $\hat{a}(x)$ and $\hat{b}(x)$ based upon the error signal, $\tilde{Q}$, between the filtered torque, Q, which results from torque output, T, of the user 10 and the current estimate of the filtered torque, $\hat{Q}$. The torque T that the user 10 is applying to the exercise machine 100 is not directly measured. A filtered version of T, Q, is obtained using a torque observer 134. The torque observer 134 requires as inputs the position x and velocity $\dot{x}$ of the exercise motion, and the desired resistance torque $\tau_d$ from the resistance controller 120. The position of the exercise motion is obtained from the position encoder/decoder 132. The torque observer calculates a filtered torque Q and sends the Q data to a comparator 135 which calculates the error in Q based on the current estimate of Q, $\hat{Q}$ obtained from the identifier algorithm 136. The identifier algorithm 136 uses the Hill relation described below to estimate Q according to strength parameters estimates $\hat{a}(x)$ and $\hat{b}(x)$, from the position data x and velocity data $\dot{x}$. The detailed operation of the torque observer 134 and the identifier algorithm 136 is shown schematically in FIG. 6, described below.

The torque observer 134 calculates the filtered torque Q. Since the torque command sent to the resistance actuator by the resistance controller 120 is known, the torque applied by the user 10 can be calculated based upon the dynamics of the exercise motion. For this to be accomplished, the inertia of the exercise motion must be known. For example, if the exercise motion is a pedaling exercise the inertia of the thighs, lower leg, and crankshaft must be known. This can be done by using charts of human inertia values for various segments of the human body, or alternatively a series of experiments can be performed to determine the inertia of the limbs. In either case, once the inertia of the motion is known the dynamic equation governing the motion can be calculated. This equation is in the following form:

$$M(x)\ddot{x}+C(x,\dot{x})\dot{x}+G(x)=T+\tau. \quad (1)$$

M(x) is the inertia of the motion, $C(x,\dot{x})\dot{x}$ are the coriolis and centripetal forces, and G(x) is the torque due to gravity. $\tau$ is the resistance torque, provided by resistance actuator 110, and T is the torque applied by the user 10. Note that, in general, the inertia term is a function of the exercise position, x. The coriolis and centripetal terms can be obtained from the spatial derivative of the inertia term, M(x). The only remaining unknown in this equation is the acceleration, $\ddot{x}$. Unfortunately, the acceleration is not measurable due to noise within the system. To circumvent this problem, the above equation can be filtered. This method eliminates the need for acceleration measurement but gives a filtered T value, Q, and not the true T. The only difference between the filtered T, Q, and the true T is some phase lag and amplitude modulation. It is this Q signal that is used by the adaptation mechanism. This signal is subtracted from the current estimate of the torque to obtain the error signal, $\tilde{Q}$, used in the identifier algorithm 136. The identifier algorithm 136 then updates the strength parameters $\hat{a}(x)$ and $\hat{b}(x)$ used to model muscle strength using the Hill relation.

The Hill relation describes the force-velocity properties of human skeletal muscle. The force producing capability of muscle declines with increasing muscle shortening velocity. This velocity dependence is not unlike that observed in a D.C. motor, except that the form of the velocity dependence is different. For muscles, the rate of decline with velocity is in the form of a smooth hyperbolic relation. The Hill relation can be applied to muscle groups actuating a motion, as well as to individual muscles. The Hill relation applies only to shortening or concentric muscle contractions. Eccentric contractions are not modeled by the Hill relation.

Muscle force is dependent on position as well as velocity. The position dependence is due to a combination of two factors. The first factor is the length dependence within the contractile machinery of the muscle fibers. The second factor affecting the position dependent strength of an individual is the kinematics of the particular motion. The kinematics determine the leverage that a particular muscle has on the bone that it is connected to and on the axis of the exercise motion. For example, during the performance of a biceps curl the maximum torque is produced when the elbow is at 90 degrees to the upper arm. When the forearm is extended or flexed to its maximum angle the amount of torque that can be applied to the forearm is reduced. These two regions are sometimes referred to as the weak points in the motion.

Figure 4:
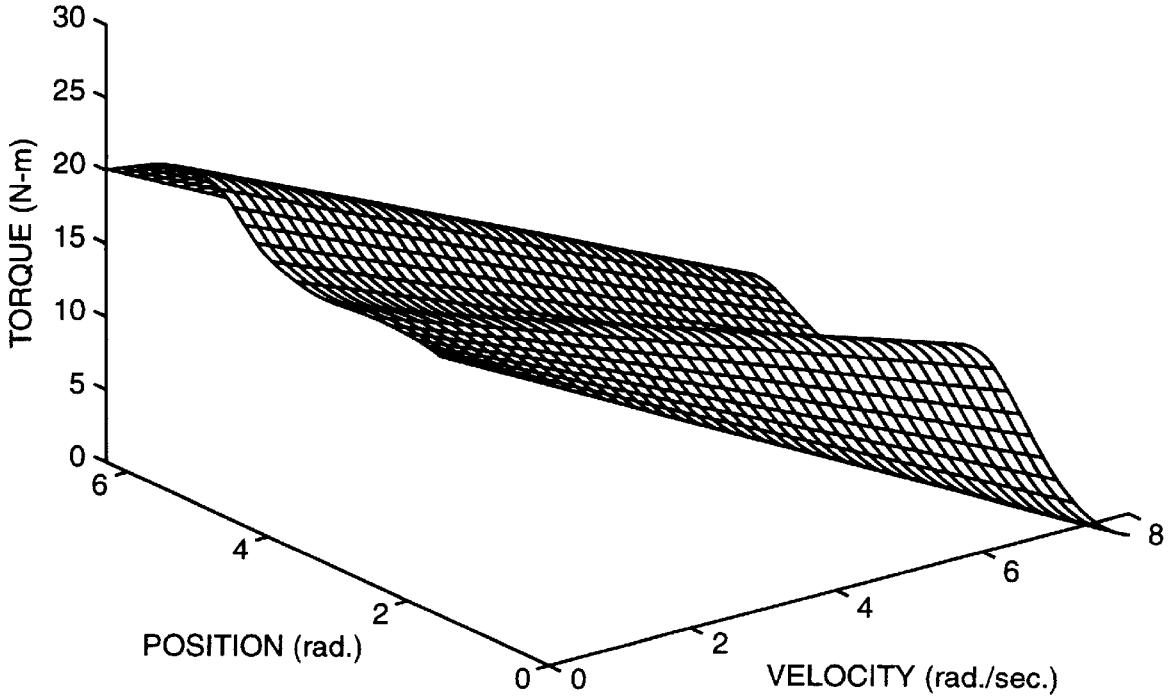
FIG. 4 is a three dimensional graphical representation of a Hill Surface.

FIG. 4 shows a plot of torque as a two dimensional function of position and velocity. Note that the velocity dependence of the surface is assumed to be linear instead of the hyperbolic velocity dependence mentioned above. The x-axis is velocity. The y-axis is position and the z-axis is Torque. This plot is called a Hill surface, A. Force may be plotted instead of torque, depending on the configuration of the exercise machine 100. Thus, given a position and velocity, the Hill surface shows the corresponding force or torque produced by the muscles involved in the motion.

The Hill surface may also change as a function of time. The time dependence can be due to either fatigue or a change in effort level. As muscles fatigue, the height of the Hill surface decreases. An increase in effort would raise the Hill surface and a decrease in effort would lower it.

As long as the exercise motion is concentric, (i.e. the muscle motion is such that the muscles shorten instead of lengthen) the Hill relation can be used to effectively model the user's strength. Bi-directional motion may be concentric since the limb flexor may be shortening during one direction of the motion and the limb extensor may be shortening during the opposite direction.

Figure 5:
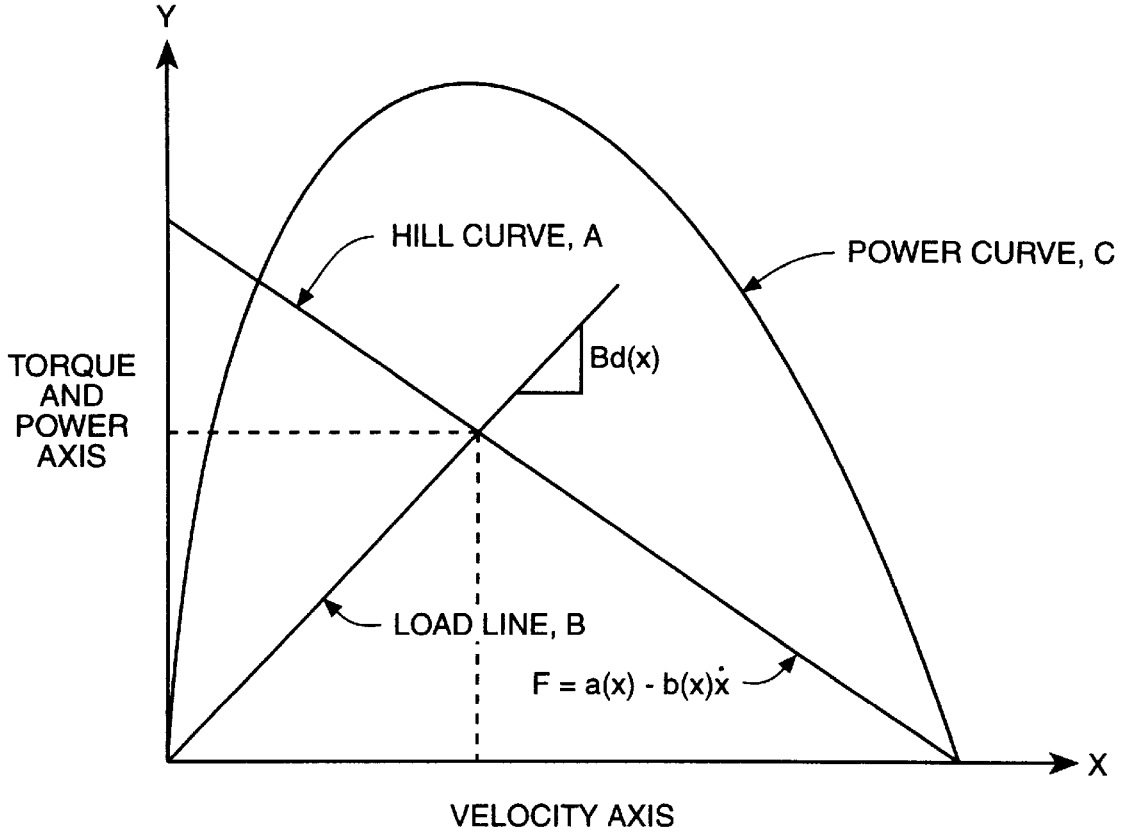
FIG. 5 is a graphical representation of the Hill relation at a constant position.

FIG. 5 shows the parameters a(x) and b(x) used to fit the Hill relation as a linear relationship, shown as Hill Curve A, between torque and velocity. The x-axis is velocity and the y-axis is torque and power. A more complicated hyperbolic relation could be used, but experiment has shown that a simple linear relation is sufficient. The torque-velocity data that has been experimentally obtained fits a linear dependence. The linear relationship in FIG. 5 is described by two parameters. The first parameter, a(x), represents the isometric strength of the user 10. The second parameter, b(x), is the slope of the Hill relation. Together, these parameters are referred to as the Hill parameters. These parameters change with the position, x, of the workout.

To identify the Hill parameters for an individual user 10, the resistance controller 120 must periodically provide an excitation phase that changes the resistive torque of exercise machine 100 between a high and low level. This causes the exercise motion to slow down and speed up alternately. High and low velocity data points are thus obtained which show the velocity dependent strength of the user 10. This process is called the "learning phase" because the muscle characteristic identifier 105 learns the value of a(x) and b(x) during this phase.

An advantage of the use of this adaptive scheme is that the resistance controller 120 can track a fatigue episode. During a fatigue episode the torque-velocity data slowly migrates to lower torque levels. If a Hill relation is continuously fit to this new data a current estimate of the fatigued strength capacity of the user 10 can be adaptively maintained. By virtue of this fatigue tracking ability the exercise machine 100 can reduce the resistance to draw more effort from the less fatiguable muscle fibers. Another advantage of the adaptive ability of the exercise machine 100 unrelated to the fatigue tracking is that it has the ability to "custom tailor" the resistance to the particular needs of the user 10, and to account for any strength gains due to training.

The power equation, $P=T\times\dot{x}$, and the fact that muscular strength declines monotonically with velocity according to the Hill relation implies that there is a velocity that will maximize the mechanical power produced by a user 10 with concentric motion. This velocity can be called the optimum shortening velocity. Depending on the curvature, or rate of decline, of the Hill relation the optimum velocity is located at about ⅓ of the maximum shortening velocity of the muscle.

It can thus be inferred from the Hill relation that there is an optimal velocity that maximizes the power of concentric exercise motion, and that this velocity is a function of the exercise position, as well as time. The preferred embodiment of this invention controls the velocity of the exercise motion so that it approaches this power maximizing velocity. This characteristic of the preferred embodiment is described as "optipoteric" from the roots opti, as in optimum, and poter, which is late Latin for power. The advantage of the invention is that once the optipoteric velocity is identified using the data gathered regarding the user's strength, the proper resistance can be calculated to cause the user to execute the exercise motion at the optipoteric velocity. Conceivably this type of workout would burn the most calories in a given amount of time.

Utilizing the strength information derived by the invention is not limited to implementing the optipoteric exercise. In other embodiments, any desired velocity profile can be implemented. This may include isokinetic or isotonic exercise. The invention may operate at any velocity profile specified. The workout can be biased toward slow velocities, or towards higher velocities. In this manner the user 10 can take advantage of the so called "Principle of Specificity", which states that an important factor in establishing a training routine is the development of exercises which will train the body in a highly specific manner, thereby improving its response to the precise demands placed upon it in competition or in everyday life.

Figure 6:
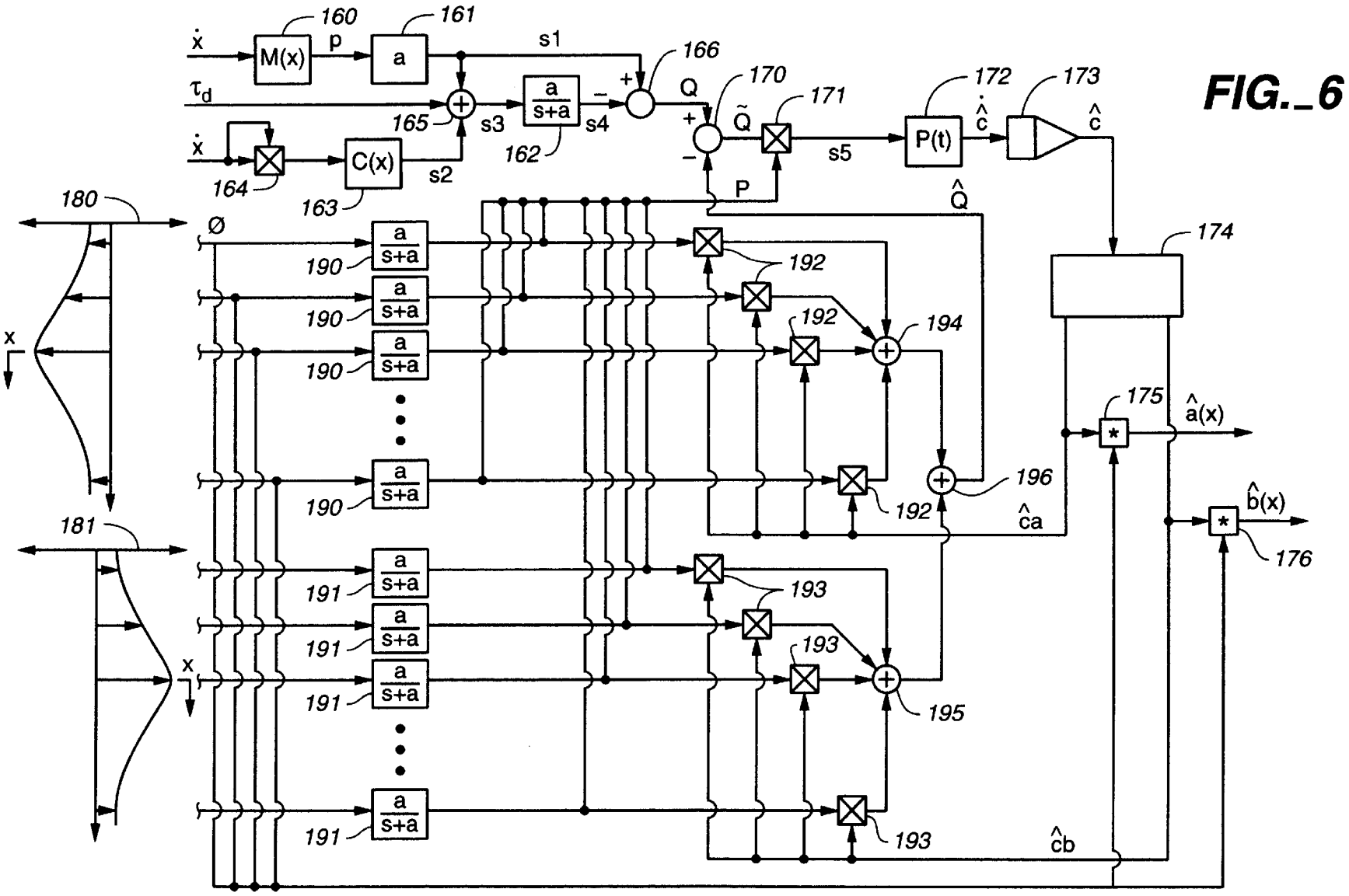
FIG. 6 is a schematic block diagram of the torque observer and the identifier algorithm of the present invention.

FIG. 6 is a detailed schematic of the adaptation mechanism 131. Blocks 160–166 comprise the force observer and blocks 170–176 comprise the identifier algorithm. The inputs to the torque observer are the velocity of the exercise machine, $\dot{x}$, which is the output of finite differencer 133, and $\tau_d$ the desired torque from resistance controller 120. The input x to the torque observer 134 is implied by the arguments to M(x) and C(x).

Multiplier 160 multiplies $\dot{x}$ by the inertia of the exercise motion, M(x). Multiplier 161 multiplies the signal p by a gain a resulting in signal s1. Multiplier 164 multiplies the input $\dot{x}$ by itself resulting in the signal $\dot{x}^2$. Multiplier 163 multiplies the signal $\dot{x}^2$ by the coriolis function of the exercise machine resulting in signal s2. Summation block 165 adds input signal $\tau_d$ with signals s1 and s2 resulting in signal s3. Filter 162 takes signal s3 and outputs signal s4 which is modified in that it has amplitude modulation and phase lag relative signal s3. Summation block 166 takes the difference of signals s4 and s1 and gives signal Q. Q represents the filtered torque output of the user 10. Summation block 170 takes the difference of Q and the current estimate of the filtered torque $\hat{Q}$ to output error signal $\tilde{Q}$ to the identifier algorithm. Multiplier 171 multiplies the vector signal ρ by the signal $\tilde{Q}$ to give the vector signal s5. Multiplier 172 represents a matrix multiplication of the vector signal s5 by the matrix P(t). Note that the matrix in block 172 it time varying. The time dependence may be specified by an appropriate update rule which will be obvious to those skilled in the art. Integrator 173 takes the vector signal $\hat{c}$ and gives the vector signal $\hat{c}$ which contains the raw information necessary to update the muscle parameters. Splitter 174 splits the vector signal $\hat{c}$ and splits it into two smaller vector signals $\hat{c}_a$ and $\hat{c}_b$. The signal $\hat{c}_a$ is the information used to update the $\hat{a}(x)$ Hill parameter and the signal $\hat{c}b$ is the information used to update the $\hat{b}(x)$ Hill parameter. Multiplier 175 takes the vector signal $\hat{c}_a$ and the first part of the unfiltered regressor ϕ from block 180, and performs the inner product operation. This operation just multiplies the two vector signals element by element and then takes the sum which will be a scalar signal. This scalar signal is the current estimate of the Hill parameter $\hat{a}(x)$.

Multiplier 176 performs the same function with the vector signal $\hat{c}_b$ producing the current estimate of the Hill parameter, $\hat{b}(x)$. Functionally speaking multipliers 175 and 176 perform the same operation as multipliers 192 and 193. Multipliers 175 and 176 are just shorthand notation of the operation of multipliers 192 and 193. Multipliers 192 and 193 multiply the filtered version of the regressor ρ by the vector signals $\hat{c}_a$ and $\hat{c}_b$. The filtering operation is done by the filters 190 and 191 respectively. Summation blocks 194 and 195 perform the addition operation on the output of summation blocks 192 and 193. Summation block 196 then adds the output of summation blocks 194 and 195 giving the current estimate of the filtered force $\hat{Q}$. Regressors 180 and 181 are internal to the identifier algorithm 136 and have as inputs x and $\dot{x}$, and output ϕ. The inputs x and $\dot{x}$ to regressors 180 and 181 are depicted as inputs to identifier algorithm 136, and not the inputs x and $\dot{x}$ going to block 134. Note that the peak in the kernel function of blocks 180 and 181 moves according to the position of the exercise motion.

FIG. 5 also shows how the resistance of the exercise machine 100 may be controlled to maximize the power output of the user 10. Load line B extends from the origin to intersect the line A used to model the Hill relation. This line represents an ideal damper with damping coefficient $B_d(x)$. The intersection of line B with line A is by definition the operating point of the user 10. The slope of the line defining the damping coefficient can be adjusted to give any operating velocity that the user 10 specifies. In particular the operating velocity can be defined to be the velocity which maximizes power, as shown by the power curve C on FIG. 5. Thus, one simple yet effective method of control is to have the resistance actuator 110 behave like a static damper with a position dependent damping coefficient, $B_d(x)$. The control law for this controller would be, $$\tau=B_d(x)\dot{x}, \tag{2}$$

where, $\dot{x}$, is the velocity of the user 10. Although simple and easy to implement, this static damper does not account for the dynamics of the motion. One way to improve this controller is to use a velocity compensation term to decrease the effective damping coefficient when the user is moving too slow and increase the effective damping coefficient when the user is moving too slow. The control would be of the form:

$$\tau=(B_d(x)+m^*s)\dot{x}, \tag{3}$$

where, $$s=V_d-\dot{x}. \tag{4}$$

A controller that does account for the dynamics of the motion and that in addition is guaranteed to be safe will be discussed below. This controller is termed a "dynamic damper".

Overall then the invention operates as follows. The torque observer 134 computes the filtered torque Q. Q is then compared with the estimate of Q, $\hat{Q}$ by comparator 135 to produce the error signal $\tilde{Q}$. Identifier algorithm 136 uses error signal $\tilde{Q}$ to update the strength parameters $\hat{a}(x)$ and $\hat{b}(x)$. Once the velocity dependence of the strength of the user 10 is known, that information may be used by the velocity profile specifier 140 to select a velocity profile which may maximize the power output by the user 10 at each point in the exercise motion or conform to any other specified criteria. The resistance controller 120 and the resistance actuator 110 then cause the motion of exercise machine 100 to conform to that velocity profile.

The specific implementation of the muscle characteristic identifier 105, the velocity profile specifier 140, the resistance controller 120, and the resistance actuator 110 in the preferred embodiment will now be described in mathematical detail.

For a single degree of freedom exercise motion, the muscle torque is a function of the configuration (position), the rate of change of configuration (velocity) of the exercise motion, and the effort level on the part of the user 10. The functional dependence of the muscle torque on position and velocity for a given effort level is assumed to satisfy:

$$T(x,\dot{x})=a(x)-b(x)\dot{x} \tag{5}$$

where $T(x,\dot{x})$ is the muscle torque when the configuration is x and its velocity is $\dot{x}$, a(x) and b(x) are functions of the configuration x.

Since the functions a(x) and b(x) describe the configuration and velocity dependent strength characteristic of the muscle, they are referred to as the muscle characteristic parameters.

In order to identify these functions, we assume that a(x) and b(x) can be further parameterized as follows:

$$a(x) = \int_0^{2\pi} h(x, \gamma)c_a(\gamma)\,d\gamma \tag{6}$$

$$b(x) = \int_0^{2\pi} h(x, \gamma)c_b(\gamma)\,d\gamma \tag{7}$$

(8)

where h(x,γ) is a smooth squared integrable function. The interpretation is that h(x,γ) is a known function (called kernel function) and $c_a(\gamma)$ and $c_b(\gamma)$ are unknown functions (called influence functions). For compactness, $c_a(\gamma)$ and $c_b(\gamma)$ are combined into a 2-vector $$\boldsymbol{c}(\gamma) = \begin{pmatrix} c_a(\gamma) \\ c_b(\gamma) \end{pmatrix}.$$

One example of h(x,γ) is the Gaussian function:

$$h(x, \gamma) = \frac{1}{\sqrt{4\pi\sigma^2}}\exp\left(-\frac{(x-\gamma)^2}{2\sigma^2}\right). \tag{9}$$

Other parameterizations of a(x) and b(x) are also possible. For example, a(x) and b(x) can be parameterized via the Fourier expansion.

Since h(x,γ) is known, the objective of identifying the muscle characteristic parameters a(x) and b(x) is translated to the identification of the influence function c(γ) (or $c_a(\gamma)$ and $c_b(\gamma)$) or of other parameter set (e.g. the Fourier coefficients when the Fourier expansion parameterization is used). The preferred embodiment focuses on the kernel/influence function parameterization case. Only a position and velocity signal is available. No direct measurement of the torque input T(t) from the human user 10 is made. Instead, we obtain the signal Q(t) which is the first order filtered (with pole at −λ) version of the user 10's torque input T(t), $$Q(t) = \frac{1}{s+\lambda}T(t). \tag{10}$$

This is reconstructed dynamically using the position and velocity signals ($x(t)$, $\dot{x}(t)$), as well as the known inertia data $M(x)$, $C(x)$, of the exercise machine 100 and the inertia of user 10's limbs using the torque observer 134. In addition to reconstructing the filtered torque $Q(t)$, the observer block also computes the filtered regressor function, $\rho(t,\cdot):[0,2\pi]\rightarrow\Re^2$ which relates the influence functions $c(\gamma)$ to the filtered torque $Q(t)$:

$$Q(t) = \int_0^{2\pi} \rho(t,\gamma)\boldsymbol{c}(\gamma)\,d\gamma. \tag{11}$$

To compute $Q(t)$, the filtered torque, the torque observer 134 receives as inputs the desired torque (desired resistive torque), $\tau_d(t)$, from the resistance controller 120, the position signal $x(t)$, and the velocity signal $\dot{x}(t)$. It outputs $Q(t)$ according to the following set of equations:

$$r(t) = \tau_d + C(x)\dot{x} + \lambda M(x)\dot{x} \tag{12}$$

$$\dot{y}(t) = -\lambda(y(t) - r(t)) \tag{13}$$

$$Q(t) = \lambda M(x)\dot{x} - y(t). \tag{14}$$

These equations are derived from the momentum balance equation which governs the relationship between the total torque ($\tau$+T) and the acceleration of inertia components. Equations (12)–(14) are then obtained by filtering both sides of the momentum balance equation with the same filter $1/s+\lambda$ as in Eq. (10).

The computation of the filtered regressor $\rho(t,\gamma)$ which is a function from $[0,2\pi]$ to $\Re^2$ is based on the position and velocity signals $x(t)$ and $\dot{x}(t)$. This is done according to the equation $$\frac{\partial\rho}{\partial t}(t,\gamma) = -\lambda[\rho(t,\gamma) - h(x(t),\gamma)(1-\dot{x}(t))]. \tag{15}$$

This allows the adaptation mechanism 133 to construct an estimate of the filtered torque $\hat{Q}(t)$ using the current estimate of the strength parameters and the filtered regressor $\rho(t,\gamma)$, and to obtain a filtered torque error $\tilde{Q}(t)$.

The filtered torque estimate $\hat{Q}$ and filtered torque error $\tilde{Q}$ are calculated from the filtered regressor $\rho(t,\gamma)$ and the influence functions estimates $\hat{c}(\gamma)$ according to the equations:

$$\hat{Q}(t) = \int_0^{2\pi} \rho(t,\gamma)\boldsymbol{c}(\gamma)\,d\gamma \tag{16}$$

$$\tilde{Q}(t) = Q(t) - \hat{Q}(t). \tag{17}$$

Finally, the filtered torque prediction error and the filtered regressor $\rho(t,\gamma)$ are used to update the influence function estimates $\hat{c}(t,\sigma)$ as follows:

The influence functions' estsimates are updated according to the prediction error $\tilde{Q}(t)$ and the filtered regressor $\rho(t,\gamma)$:

$$\frac{\partial}{\partial t}\hat{\boldsymbol{c}}(t,\sigma) = -\int_0^{2\pi} \boldsymbol{P}(t,\sigma,\chi)\rho(t,\chi)\tilde{Q}(t)\,d\chi \tag{18}$$

where $P(t,\sigma,\chi)$ is the time varying gain operator. The gain operator $P(t,\sigma,\chi)$ is in turn updated according to the least square with forgetting factor update rule:

$$\frac{\partial}{\partial t}\boldsymbol{P}(t,\sigma,\chi) = -\frac{\int_0^{2\pi}\boldsymbol{P}(t,\sigma,\gamma)\rho(t,\gamma)\,d\gamma\cdot\int_0^{2\pi}\boldsymbol{P}(t,\chi,\gamma)\rho(t,\gamma)\,d\gamma}{1+\int_0^{2\pi}\rho(t,\gamma)^2\,d\gamma} + \lambda_f\boldsymbol{P}(t,\sigma,\chi) - \lambda_f P_0^{-1}\int_0^{2\pi}\boldsymbol{P}(t,\sigma,\gamma)\boldsymbol{P}(t,\chi,\gamma)\,d\gamma.$$

with initial conditions:

$$P(0,\sigma,\chi)=P_0\delta(\sigma,\chi) \tag{19}$$

where $\delta(\sigma-\chi)$ is the Dirac impulse. $\lambda_f$, $P_0>0$ are the positive forgetting factor and the term that determines the upper bound of P respectively.

The particular form of the update law shown here is the least squares with forgetting factor method. Other update methods in the literature are also applicable and will be known by those skilled in the art.

In the implementation of the functional dynamic equations on a digital computer, the influence functions $c_a$, $c_b$: $[0,2\pi]\rightarrow\Re$ are discretized spatially into a vector $(c_{a,x_0}, c_{a,x_2}, \ldots, c_{a,x_n})$ where $c_{a,x_1}$ approximates the value of the continuous function $c_a(\cdot)$ at $i2\pi/n$. Similarly for $c_b(\cdot)$. The gain operator $P(t,\sigma,\chi)$ becomes a $2n\times 2n$ matrix. The integration of the dynamic equations in (13) and (18)–() also have to be discretized temporally using the standard integration rule, e.g. the forward or backward euler algorithms.

The velocity profile specifier 140 determines the desired velocity profile $V_d(x,t)$ which in turn specifies the desired exercise that the user 10 should perform based on the strength characteristic of the user 10, the state of the identification of the strength, and the goal of the exercise, which is input by the user 10. If the goal of the exercise is to consume the maximum amount of calories, the optipoteric exercise is chosen by the user 10 and a velocity profile that corresponds to the optipoteric exercise will result. Specifically, when the Hill relation of strength as a function of velocity is modeled by:

$$T(x,\dot{x})=a(x)-b(x)\dot{x}$$

then the exercise that maximizes the modified power with index $\gamma$ for $\gamma>0$, $$P_\gamma=\text{Torque}\cdot\text{Velocity}^\gamma$$

is given by the velocity profile:

$$V_d(x) = \frac{\gamma a(x)}{(\gamma+1)b(x)} \tag{20}$$

In particular, for $\gamma=1$, the mechanical power is maximized when the velocity of the exercise at position x is $$V_d(x) = \frac{1}{2}\frac{a(x)}{b(x)}.$$

If the desired exercise is an isokinetic exercise, the desired velocity profile $V_d(x)$ is specified to be a constant.

Assume that a desired exercise is given in terms of a velocity profile $V_d(x,t)$, i.e. a specification of the velocity of the exercise at each configuration of the exercise motion. The resistive torque to the exercise motion has to be controlled by the resistance controller 120 so that the user 10 actually executes the desired velocity profile. To accomplish this task, a model of the user 10's strength characteristic is obtained from the muscle characteristic identifier 105.

The identification of the muscle model relies on the assumption that the user 10's effort level/fatigue state does not change rapidly. It is possible for the user 10 to activate his/her muscles in such a way that the muscle torque predicted by the model is completely inaccurate. When this happens, the resistive torque to the exercise motion, if computed from the inaccurate model, could cause the exercise machine 100 to become unstable, causing possible injury to the user 10. In order to make sure that the controlled exercise machine 100 is safe regardless of inaccuracies of the model, the control torque is computed in a way that the exercise machine 100 under control only stores or dissipates energies, but does not create energy. We call a controlled system with such a property a passive controlled system.

Precisely speaking, for the one degree of freedom exercise machine with position variable x, and human torque T we say that the controlled exercise machine 100 is passive if, for any user 10's torque $T(\tau)$, and at any time t>0, $$\int_0^t T(\sigma)\dot{x}(\sigma)\,d\sigma \geq -\epsilon^2. \tag{21}$$

where $\dot{x}(t)$ is the time derivative of the position x.

Let us define the kinetic energy of the overall system (exercise machine 100 together with the inertia of the user 10) to be:

$$E(t) = \frac{1}{2}M(x(t))\dot{x}(t)^2. \tag{22}$$

Applying an energy balance to the overall system, and taking the time derivative, we obtain $$\dot{E}(t)=\tau(t)\dot{x}(t)+T(t)\dot{x}(t) \tag{23}$$

where $T(t)\dot{x}(t)$ is the power input from the user 10, and $\tau(t)\dot{x}(t)$ is the power input from the controller. If the desired velocity field is followed, then we can substitute $\dot{x}(t)$ by $V_d(x(t),t)$ in (22). Differentiating this expression with respect to time, and substituting $\dot{x}(t)$ by $V_d(x(t),t)$ again, $\dot{E}$ can thus be written as a function of the configuration of the exercise motion and time as follows: (with a slight abuse of notation for E(x,t):

$$\dot{E}(x,t) := \frac{1}{2}\frac{d\{[M(x)\cdot V_d(x,t)^2\}}{dx}V_d(x,t) + \frac{1}{2}M(x)\frac{\partial V_d(x,t)^2}{\partial t}. \tag{24}$$

where M(x) is the inertia of machine and the user 10's limbs at configuration x. Since the velocity field to be tracked is arbitrary, it is possible that $\dot{E}(x,t)$ in (23) may be greater than the power from the user 10 at the desired velocity in certain portions of the exercise motion, so that $\tau(t)\dot{x}$ must be positive in order for (23) to be satisfied, i.e. the $\tau(t)$ is concentric to the exercise motion. In this situation, it is necessary for the controller to inject energy to the exercise machine 100 (as opposed to just dissipate energy as in most conditions) helping the user 10 push in the direction of the desired motion.

In order to satisfy the passivity constraint (21) while still preserving the ability for the controller to help out the user 10, the preferred embodiment of the current invention uses a passive dynamic controller: a controller which does not create energy but only stores and dissipates energy.

The dynamic damping controller has as inputs the position x(t) and velocity $\dot{x}(t)$ of the exercise motion and outputs the desired exercise resistance $-\tau_d(t)$ ($\tau_d>0$ is a concentric torque, $\tau_d<0$ is an eccentric torque) according to the equation:

$$\hat{F}_d(x,t) = \hat{a}(x) - \hat{b}(x)V_d(x,t)$$

where $M_2>0$ and, $R(x,\dot{x},t)\epsilon\,\Re^{2x2}$ is a positive definite matrix with skew symmetric off diagonal entries, and v is an internal variable (state) of the controller. Since the output of the controller (i.e. the desired resistance torque $\tau$) cannot be determined by the current values of the inputs (x and $\dot{x}$), this is a dynamic controller and requires an internal dynamic variable (state) v.

The rule for tuning the matrix R in the dynamic damping controller is shown below:

The data input is the positive desired velocity profile $V_d(x,t)>0$; M(x), the inertia of the exercise machine and user 10, and $\hat{F}_d(x,t)$, the estimate of the human torque at position x and velocity $V_d(x,t)$. $\hat{F}_d(x,t)$ is given by:

$$\hat{F}_d(x,t)=\hat{a}(x)-\hat{b}(x)V_d(x,t)$$

$\hat{F}_d(x,t)$ will normally be obtained from the influence function estimates or the Hill parameters estimates as described in the previous section.

This information is combined to obtain the Dynamic damping controller's coefficients $M_2\,\epsilon\,\Re$, and $R(x,\dot{x},t)\epsilon\,\Re^{2x2}$ by the following procedure:

STEP 1

Choose $M_2>0$, $V_{d2}(x,t)>0$ and $\bar{E}>0$ such that: for all $x\epsilon[0,2\sigma]$ and t>0

$$M(x)V_d(x,t)^2+M_2(x)V_{d2}(x,t)^2=\bar{E}, \tag{26}$$

STEP 2

Define R(x,t) to be $$R(x,\dot{x},t)=B(x,t)-Q_x(x,\dot{x},t)-Q_t(x,\dot{x},t) \tag{27}$$

where $$\boldsymbol{B}(x,t) = \frac{\hat{F}_d(x,t)}{\bar{E}}\begin{pmatrix} M(x)V_d(x,t) & M_2V_{d2}(x,t) \\ -M_2V_{d2}(x,t) & M_2V_d(x,t) \end{pmatrix};$$

$$\boldsymbol{Q}_x(x,\dot{x},t) = -\frac{\dot{x}}{V_d(x,t)}M_2\frac{\partial V_{d2}}{\partial x}(x,t)\begin{pmatrix} 0 & 1 \\ -1 & 0 \end{pmatrix}$$

-continued $$Q_t(x,t) = \frac{\left(\frac{\partial MV_d}{\partial t} M_2 V_{d2} - M_2 \frac{\partial V_{d2}}{\partial t} MV_d\right)\Big|_{(x,t)}}{\overline{E}(t)} \begin{pmatrix} 0 & 1 \\ -1 & 0 \end{pmatrix}.$$

Roughly speaking, the three components in (27) serve three distinct purposes: i) B can be thought of as the damping coefficient such that when the desired velocity field is executed, all the power input from the user 10 is dissipated, ii) $Q_x(x,\dot{x},t)$ accounts for the position dependence of the human power input (which depends on the Hill parameters); iii) $Q_t(x,\dot{x},t)$ accounts for the time variation of the human power input due to time variation of the desired velocity profile.

The use of the dynamic controller allows accounting of the energy flow between the exercise machine 100 and the control system. In other words, the dynamics of the controller provides a way by which mechanical energy is stored temporarily within the controller before being dissipated or returning to the exercise machine 100 at the correct moment.

In fact, if we define the total energy of the exercise machine 100 together with the energy stored within the controller to be:

$$E_{tot}(x,\dot{x},v) = \frac{1}{2}M(x)\dot{x}^2 + \frac{1}{2}M_2 v^2, \tag{28}$$

then, it can be shown that $$\int_0^t T(\sigma)\dot{x}(\sigma)\,d\sigma \geq -E_{tot}(x(0),\dot{x}(0),v(0)).$$

This shows that the controlled system is passive as defined above. It can also be shown that if the dynamic controller is defined as above, and the estimate of the human torque $\hat{F}_d(x,t)$ is accurate, then the velocity of the exercise motion converges to the desired velocity exponentially.

The resistive torque specified by the dynamic controller described above is generated by the resistance actuator 110. The realization of the control system may be achieved by any embodiment which provides the desired torque, including the following active resistance actuator and semi-active resistance actuator.

Figure 7:
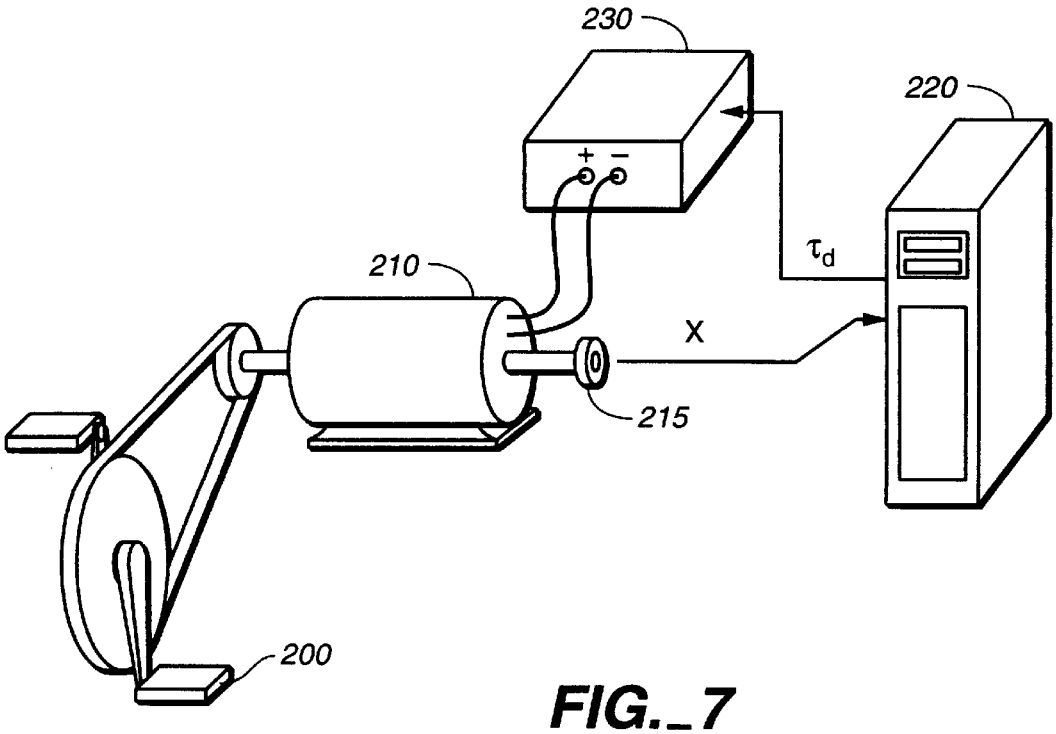
FIG. 7 is a schematic diagram of a system in accordance with the present invention.

A simple way to achieve the desired "resistive" torque, which may sometimes need to be concentric to help the user 10 in a certain portion of the exercise motion, is shown in FIG. 7. FIG. 7 illustrates an embodiment of the elements shown schematically in FIG. 1. Exercise bike 200, for example, is used for exercise machine 100. Exercise bike 200 is connected to D.C. motor 210, which functions as the resistance actuator 110. The resistance controller 110, the velocity profile specifier 140, and the muscle characteristic identifier 105 are all implemented on computer 220, which receives position signals from optical encoder 215. D.C. motor 210 is capable of delivering the torque specified by the resistance controller 120 either directly or via a transmission. The output torque of the D.C. motor 210 is controlled by computer 220 by changing the inductive current of the motor via the motor driver 230. The D.C. motor 210 described in this embodiment is an active actuator because it has the capability to generate torques on demand. Such a device can be expensive and may add significantly to the cost of the equipment.

Figure 8A:
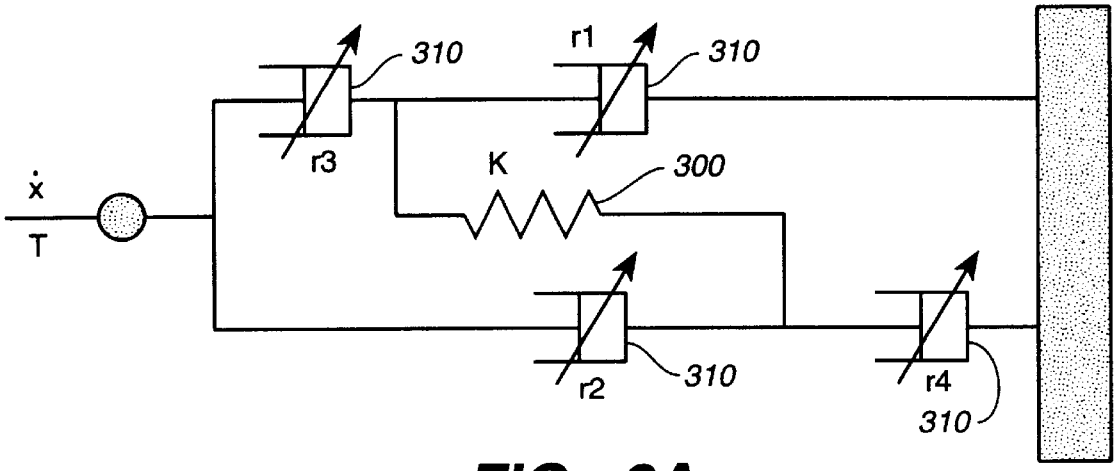
FIGS. 8A and 8B are schematic representations of a semi-active actuator in accordance with the present invention.
Figure 8B:
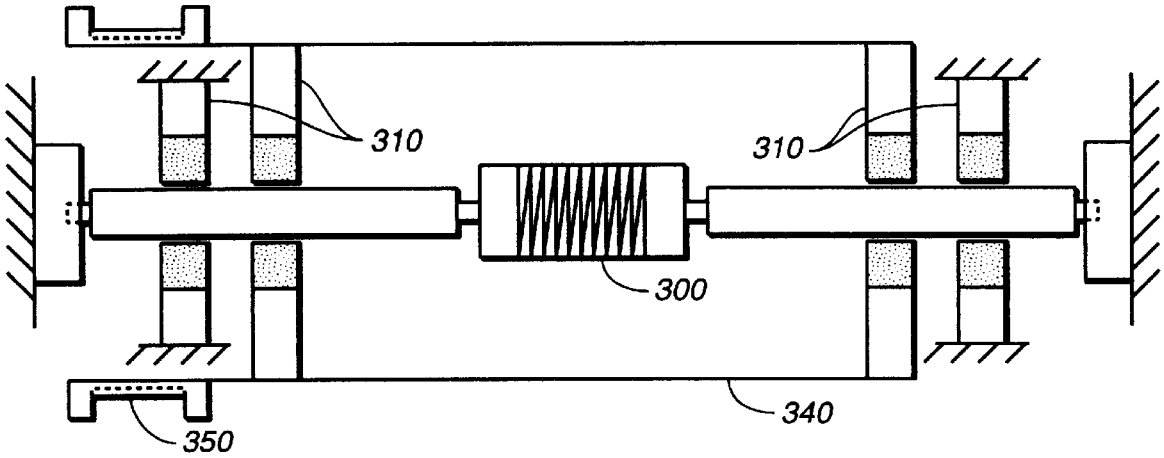

In another embodiment, a semi-active device may be used to implement both the resistance controller 120 and the resistance actuator 110. The semi-active actuator is shown in FIGS. 8A and 8B and implements the dynamic controller using only passive mechanical elements: a spring 300 with spring constant K, and four variable dampers 310 with damping coefficients $r_1, \ldots, r_4$ produce the desired torque on cylinder 340 and belt drive 350. The spring and damper system may be implemented with rotary spring 300 and variable dampers 310 for circular exercise motion, as shown in FIG. 8B. Notice that the semi-active actuation scheme combines the resistance controller 120 and the resistance actuator 110 form FIG. 3.

For any $\alpha>0$, the dynamics of the realization shown in FIGS. 8A and 8B is given by:

$$\begin{pmatrix} \tau \\ \frac{\alpha^2}{K}\dot{f}' \end{pmatrix} = \begin{pmatrix} -\left(\frac{r_1 r_3}{r_1+r_3} + \frac{r_2 r_4}{r_2+r_4}\right) & \alpha\left(\frac{r_3}{r_1+r_3} - \frac{r_2}{r_2+r_4}\right) \\ \alpha - \left(\frac{r_3}{r_1+r_3} + \frac{r_2}{r_2+r_4}\right) & -\alpha^2\left(\frac{1}{r_1+r_3} + \frac{1}{r2+r4}\right) \end{pmatrix} \begin{pmatrix} \dot{x} \\ f' \end{pmatrix} \tag{29}$$

where $\tau$ is the torque output of the device concentric to the motion, f' is the internal variable related to the compressive force of the spring f by: $f'=\alpha f$. The off diagonal components of this matrix is skew symmetric and the matrix itself is positive definite for positive $r_1, \ldots r_4$, as is $R(x,\dot{x},t)$.

By changing the damping coefficients $r_1, \ldots, r_4$ online, the torque specified by the dynamic damping controller (25) can be realized under the following condition on the matrix R:

A constant $\alpha>0$ exists such that the following is satisfied for all (x,t), $$|R_{12}(x,t)| \leq \alpha \leq \frac{R_{11}(x,t)R_{22}(x,t) + R_{12}^2(x,t)}{|R_{12}(x,t)|}.$$

Such an $\alpha$ exists if $$\min_{(x,t)}\left(\frac{R_{11}R_{22} + R_{12}^2}{|R_{12}|}\right) > \max_{(x,t)}|R_{12}| \tag{30}$$

This condition can often be satisfied by choosing $M_2$ and $\overline{E}$ appropriately.

If this condition is satisfied, then the rules for picking the spring constant K and tuning of the coefficients of the variable dampers for realization in FIG. 8A are given as follows:

Suppose the desired controller is given by:

$$\begin{pmatrix} \tau \\ M_2\dot{v} \end{pmatrix} = -\begin{pmatrix} R_{11}(x,t) & -R_{12}(x,t) \\ R_{12}(x,t) & R_{22}(x,t) \end{pmatrix}\begin{pmatrix} \dot{x} \\ v \end{pmatrix}.$$

STEP 1

Choose a constant $\alpha$ that satisfies (30). Set spring constant K to be:

$$K = \frac{\alpha^2}{M_2}. \tag{31}$$

STEP 2

Choose the damping coefficients $r_1$, $r_2$, $r_3$ and $r_4$ according to the sign of $R_{12}$ If $R_{12}>0$ $$r_1 = \alpha \frac{R_{11}}{|R_{12}|}$$

$$r_2 = 0$$

$$r_3 = \frac{\alpha R_{11}}{\alpha - |R_{12}|}$$

$$r_4 = \frac{\alpha^2(r_1 + r_3)}{R_{22}(r_1 + r_3) - \alpha^2}.$$

If $R_{12}<0$, $$r_1 = \frac{\alpha^2(r_2 + r_4)}{R_{22}(r_2 + r_4) - \alpha^2}$$

$$r_2 = \frac{\alpha R_{11}}{\alpha - |R_{12}|}$$

$$r_3 = 0$$

$$r_4 = \alpha \frac{R_{11}}{|R_{12}|}$$

These equations describe how the damping coefficients should be tuned. The tuning of the dampers 310 may be performed by a microcomputer which also handles the calculation of the coefficients of the dynamic controller. Notice that although the realization of the controller uses only passive mechanical devices, because the spring is capable of storing energy, the semi-active actuation scheme is still capable of helping out the user 10 in those portion of the exercise motion where concentric torque from the machine is needed.

The exact components used to realize the spring 300 and the tunable dampers depend on the exact configurations of the exercise motion involved, spatial constraints and economics. For example the tunable dampers can be fluid based (variable orifice or magnetically sensitive fluid), electrical based (inductive brakes), and the spring can be a linear or a coil mechanical spring, or a magnetic spring.

In summary, an apparatus and method for testing a user 10's strength characteristics and adapting the resistive torque of an exercise machine 100 according to those characteristics has been described.

The present invention has been described in terms of a preferred embodiment. The invention, however, is not limited to the embodiment depicted and described. Rather, the scope of the invention is defined by the appended claims.

What is claimed is:

1. A method of providing a resistance force to a user of an exercise machine which includes a member which is movable along a path and which is configured to engage a part of the user's body to execute an exercise motion in which the member has a position and a velocity, comprising:

sensing the position and the velocity of the member during the exercise motion, determining a user force exerted by the user along the path from a parameterized function of the position and the velocity, determining a velocity profile as a varying function of the position, and providing the resistance force in a manner to cause the velocity to follow the velocity profile.

2. The method of claim 1 wherein the velocity profile is based on parameters of the parameterized function.

3. The method of claim 2 wherein the parameters are identified by periodically changing the resistance force in a manner such that the user moves the member at at least two velocities at each position along the exercise path, measuring the velocity, position and resistance force, and determining the parameters from these measurements.

4. The method of claim 1 wherein the step of determining the velocity profile includes:

determining a velocity profile according to a criteria which maximizes the amount of power produced by the user.

5. The method of claim 1 wherein the exercise machine has a rotating axis and the user force includes only a force applied by the user's muscles to the rotating axis.

6. The method of claim 1 wherein the user force does not include a force due to inertia of the user's body or the exercise machine.

7. The method of claim 1 wherein the user force does not include a Corliois force associated with the user's body or the exercise machine.

8. The method of claim 1 wherein data used to determine the user force consists essentially of the resistance forces the position and the velocity.

9. The method of claim 1 wherein providing the resistance force in a manner to cause the velocity to follow the velocity provide includes predicting future values of the user force as a function of position and velocity.

10. The method of claim 9 wherein the velocity profile is based on parameters of the parameterized function.

11. An exercise machine, comprising:

a member which is movable along a path and which is configured to engage a part of a user's body, a resistive device connected to the member to provide a resistance force to the user who executes an exercise motion in which the member has a position and a velocity, a sensor to measure the position and the velocity of the member during the exercise motion, a processor coupled to the sensor and configured to determine a user force exerted by the user along the path from a parameterized function of the position and the velocity, the processor further configured to determine a velocity profile as a varying function of the position, and a controller coupled to the resistance device and configured to adjust the resistance force to cause the velocity to follow the velocity profile.

12. The machine of claim 11 wherein the velocity profile maximizes the amount of power produced by the user.

13. The machine of claim 11 wherein the controller includes a static damper.

14. The machine of claim 11 wherein the controller includes a dynamic damper.

15. The machine of claim 11 wherein the processor is configured to iteratively evaluate parameters of the parameterized function.

16. The machine of claim 15 wherein the user force, T, is determined by a strength function $T=a(x)+b(x)\dot{x}$, where x is the position, $\dot{x}$ is the velocity, and a(x) and b(x) are the parameters of the parameterized function.

17. The machine of claim 15 wherein the processor is configured to determine the momentum of the exercise motion, $p=M(x)\dot{x}$, the Coriolis and centripetal force, $C(x,\dot{x})\dot{x}$, the gravity force G(x), and the resistance force, $\tau$, and the processor is further configured to determine a filtered force Q, according to the equation, $Q=a\cdot p-[a/(s+a)][a\cdot p+C(x,\dot{x})\dot{x}^2+\tau]$, where a is a filtering constant and s is a filtering variable.

18. The machine of claim 17 wherein the parameters are updated using a linear combination of a velocity error signal and a force error signal, wherein the velocity error signal is the difference between the velocity profile and the velocity and the force error signal is the difference between the filtered force and an estimate of the filtered force determined from the estimated model parameters from a prior iteration.

19. The machine of claim 13 wherein the controller is configured to store and dissipate energy provided by the user but not generate energy.

20. The machine of claim 19 wherein the controller is configured to recursively update a variable representing energy stored by the controller.

21. The machine of claim 20 wherein the resistive device is selected from the group consisting of electromagnetic actuators, electromagnetic brakes, magnetically sensitive fluid dampers, and variable orifice hydraulic dampers.

22. The machine of claim 19 wherein the resistive device includes a spring and first, second, third and fourth tunable dampers.

23. The machine of claim 22 wherein the member is connected to a first terminal of each of the first and second dampers, a first terminal of the spring is connected to a second terminal of the first damper, a second terminal of the spring is connected to a second terminal of the second damper, a first terminal of each of the third and fourth dampers is connected to a stationary point, a second terminal of the third damper is connected to the second terminal of the spring, and the second terminal of the fourth damper is connected to the first terminal of the spring.

24. The machine of claim 14 wherein the controller is configured to dissipate energy provided by the user but not store or generate energy.

* * * * *

UNITED STATES PATENT AND TRADEMARK OFFICE

CERTIFICATE OF CORRECTION

PATENT NO. : 5,919,115

DATED : July 6, 1999

INVENTOR(S) : Horowitz et al.

It is certified that error appears in the above-identified patent and that said Letters Patent is hereby corrected as shown below:

Claim 8, column 16, line 24, change "forces" to --force,--,
Claim 9, column 16, line 28, change "provide" to --profile--,
Claim 19, column 17, line 12, change "13" to --14--,
Claim 24, column 18, line 15, change "14" to --13--.

Signed and Sealed this

Thirtieth Day of January, 2001

*Attest:*

Q. TODD DICKINSON

*Attesting Officer*

*Director of Patents and Trademarks*